US010264928B1

(12) United States Patent
Cox

(10) Patent No.: US 10,264,928 B1
(45) Date of Patent: Apr. 23, 2019

(54) BATHROOM STORAGE DEVICE

(71) Applicant: John Cox, River Forest, IL (US)

(72) Inventor: John Cox, River Forest, IL (US)

(73) Assignee: John Cox, River Forest, IL (US)

( * ) Notice: Subject to any disclaimer, the term of this patent is extended or adjusted under 35 U.S.C. 154(b) by 0 days.

(21) Appl. No.: 15/933,029

(22) Filed: Mar. 22, 2018

Related U.S. Application Data

(63) Continuation-in-part of application No. 29/628,948, filed on Dec. 8, 2017, and a continuation-in-part of application No. 29/636,996, filed on Feb. 13, 2018.

(51) Int. Cl.
*A47K 10/22* (2006.01)
*B65D 25/10* (2006.01)
*E03C 1/308* (2006.01)

(52) U.S. Cl.
CPC ..... *A47K 10/22* (2013.01); *B65D 25/106* (2013.01); *E03C 1/308* (2013.01)

(58) Field of Classification Search
CPC ..... B65D 25/106; A47K 10/22; A47K 17/00; A47K 10/18; A47K 10/16; A47K 11/10
USPC ..... 206/225, 233, 361, 581
See application file for complete search history.

(56) References Cited

U.S. PATENT DOCUMENTS 3,275,133 A * 9/1966 Wood ..... A47K 10/22 206/394
3,429,474 A 2/1969 Cann
4,008,933 A 2/1977 Wanek
4,192,561 A * 3/1980 Gunn ..... A47K 10/22 206/397
4,273,392 A * 6/1981 Stinson ..... A47K 10/22 206/394
4,432,451 A * 2/1984 Hooser ..... A47K 10/22 206/216
5,040,679 A 8/1991 Rehmann
5,456,356 A * 10/1995 Kurzawa ..... A47K 10/22 206/225
D374,584 S 10/1996 Freeman
5,887,818 A * 3/1999 Kelley ..... A47K 10/22 242/559.3
5,971,141 A 10/1999 Shafik
5,984,100 A 11/1999 Ramsey et al.
6,050,401 A 4/2000 Michaelson
6,109,429 A 8/2000 Cunningham et al.
6,193,059 B1 2/2001 Massaro
D458,068 S 6/2002 Hillman
6,729,470 B2 5/2004 Watlington
6,769,542 B2 8/2004 Polito
(Continued)

*Primary Examiner* — Steven A. Reynolds
(74) *Attorney, Agent, or Firm* — McCracken & Gillen LLC

(57) ABSTRACT

A bathroom storage device for convenient concealed storage of a toilet plunger and visible storage of multiple vertically stacked rolls of toilet paper. The cup of the toilet plunger is concealed within a base unit having an open top from which the handle of the toilet plunger protrudes. A top member with a hollow vertical spindle is placed over the open top, thereby concealing the cup and handle of the toilet plunger within the base unit and hollow vertical spindle, respectively. Spaced vertical members about the periphery of the top member partially conceal the vertically stacked rolls of toilet paper while still enabling visual ascertainment of their number. The hollow vertical spindle may serve as a handle by which the top member and stacked rolls of toilet paper can be removed to gain access to the toilet plunger.

12 Claims, 4 Drawing Sheets

(56) References Cited

U.S. PATENT DOCUMENTS

| | | | | |
|---|---|---|---|---|
| 6,854,596 | B1 | 2/2005 | Wiese | |
| 6,926,137 | B2 * | 8/2005 | Rudnick | B65D 43/26 206/15.3 |
| 2002/0100705 | A1 * | 8/2002 | Phillips | A47K 11/10 206/349 |
| 2003/0173243 | A1 * | 9/2003 | Polito | A47K 10/22 206/361 |
| 2003/0226777 | A1 * | 12/2003 | Benson | A45C 11/24 206/349 |
| 2008/0073243 | A1 | 3/2008 | Rosh | |
| 2009/0045083 | A1 | 2/2009 | Vaults, Jr. | |
| 2011/0168581 | A1 * | 7/2011 | Williams | A47K 10/22 206/216 |
| 2015/0090717 | A1 | 4/2015 | Marcell | |
| 2016/0075473 | A1 * | 3/2016 | Stuart | B65D 25/06 206/508 |
| 2016/0309971 | A1 | 10/2016 | Gormeley | |

* cited by examiner

BATHROOM STORAGE DEVICE

RELATED APPLICATIONS

This application is a continuation-in-part of U.S. Design patent application Ser. No. 29/628,948, entitled "Bathroom Accessory" and filed on 8 Dec. 2017, and a continuation-in-part of U.S. Design patent application Ser. No. 29/636,996, entitled "Bathroom Accessory" and filed on 13 Feb. 2018, the contents of both of which are incorporated herein by reference.

FIELD OF THE INVENTION

The present invention relates to lavatory maintenance, and more particularly, to an enclosure for storing and concealing toilet sanitation products and/or tools.

BACKGROUND OF THE INVENTION

A toilet plunger typically includes a handle and a suction head, or cup, that is used to plunge a bathroom toilet by forcing air and/or liquid into and out of a drain opening, such as a drain pipe for the toilet bowl. Simple placement of an exposed toilet plunger in a bathroom is neither aesthetically pleasing nor sanitary. However, storing the toilet plunger out of sight may render access to it difficult when needed. Therefore, it is desirable to have the toilet plunger close at hand, though preferably concealed within a container.

Numerous types of stands, containers, and/or storage assemblies for storing toilet plungers are known in the art. Such devices are desirable for providing a convenient receptacle for the toilet plunger between uses, as well as masking the unsightly view of the toilet plunger.

However, such conventional containers have several disadvantages, including being unattractive in appearance and unable to blend in with the overall decor or aesthetics of the bathroom. Also, a user must often make contact with both the toilet plunger and the container to store and remove the toilet plunger in and from the container, which may be inconvenient to the user as well as unsanitary. Further, the toilet plunger may inadvertently become dislodged from the container during transport. Still further, where space is at a premium, there may not be sufficient space to store a plunger as well as other toilet necessities within a reasonable distance from the toilet bowl. For example, extra rolls of toilet paper may be unsightly and take up a great deal of space. However, easy access to extra rolls is necessary when a primary roll is exhausted.

Accordingly, it is desirable to provide a storage assembly for storing a toilet plunger and/or toilet paper that is cost-effective, minimalistic, multi-functional and makes efficient use of floor space around it.

SUMMARY

A bathroom storage device is provided for convenient concealed storage of a toilet plunger and visible storage of multiple vertically stacked rolls of toilet paper. The cup of the toilet plunger is concealed within a base unit having an open top from which the handle of the toilet plunger protrudes. A top member with a hollow vertical spindle is placed over the open top, thereby concealing the cup and handle of the toilet plunger within the base unit and hollow vertical spindle, respectively. Spaced vertical members about the periphery of the top member partially conceal the vertically stacked rolls of toilet paper while still enabling visual ascertainment of their number. The hollow vertical spindle may serve as a handle by which the top member and stacked rolls of toilet paper can be removed to gain access to the toilet plunger.

In accordance with exemplary embodiments, an apparatus for storing a toilet plunger and multiple rolls of toilet paper includes a base container and a cover unit. The base container includes a top opening having a cross-sectional shape suitable for accommodating placement of a cup of the toilet plunger within the base container. The cover unit includes: a base portion with a generally vertical bottom flange that is disposed circumferentially about and extends generally downward from the base portion and is adapted to enable mechanical engagement of the base portion with the top opening of the base container; a plurality of members spaced radially about and extending upwardly from a periphery of the base portion; and a hollow spindle mechanically engaged with and protruding generally upward from a top of the base portion, and adapted to accommodate insertion of a handle of the toilet plunger within the hollow spindle and placement of a plurality of rolls of toilet paper about the hollow spindle.

In accordance with further exemplary embodiments, an apparatus for storing a toilet plunger and multiple rolls of toilet paper includes a base container, a cover unit and a hollow spindle. The base container includes a top opening having a cross-sectional shape suitable for accommodating placement of a cup of the toilet plunger within the base container. The cover unit includes: a base portion with a generally vertical bottom flange that is disposed circumferentially about and extends generally downward from the base portion and is adapted to enable mechanical engagement of the base portion with the top opening of the base container; and a plurality of members spaced radially about and extending upwardly from a periphery of the base portion. The hollow spindle is adapted to be mechanically engaged with and protrude generally upwardly from a top of the base portion, following which the hollow spindle accommodates insertion of a handle of the toilet plunger within the hollow spindle and placement of a plurality of rolls of toilet paper about the hollow spindle.

DETAILED DESCRIPTION

The following detailed description is of example embodiments of the presently claimed invention with references to the accompanying drawings. Such description is intended to be illustrative and not limiting with respect to the scope of the present invention. Such embodiments are described in sufficient detail to enable one of ordinary skill in the art to practice the subject invention, and it will be understood that other embodiments may be practiced with some variations without departing from the spirit or scope of the subject invention.

Figure 1:
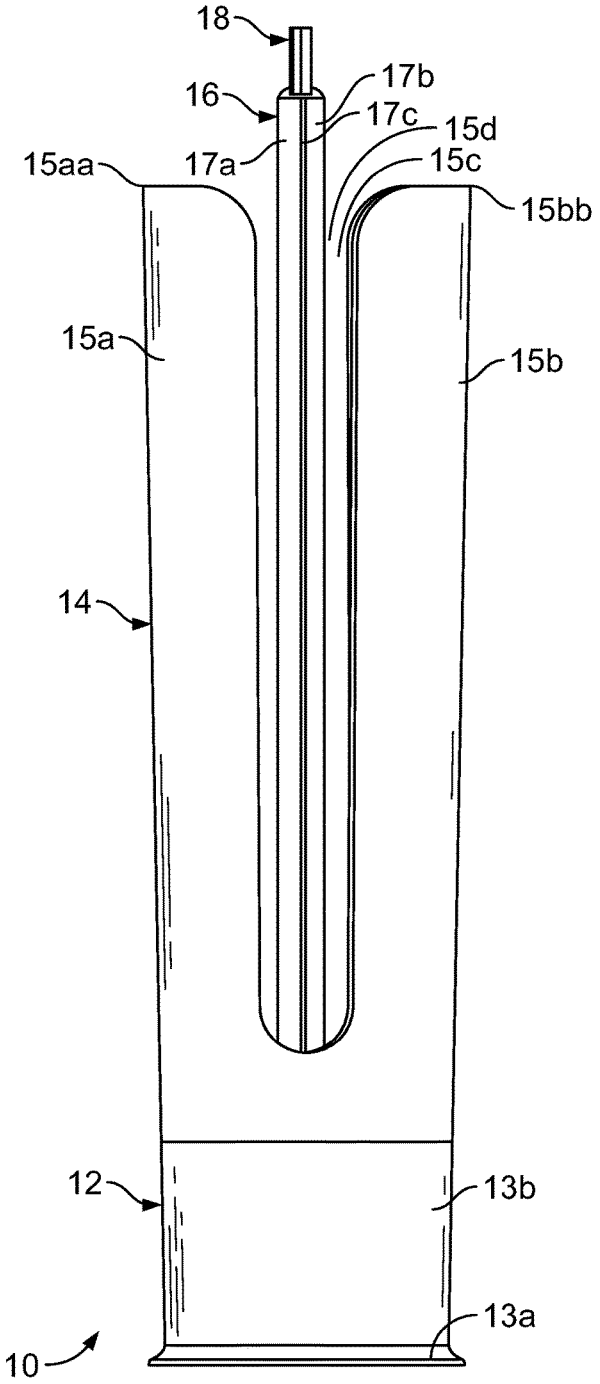
FIG. 1 depicts a side view of a storage device in accordance with exemplary embodiments.

Referring to FIG. 1, a storage device 10 in accordance with exemplary embodiments includes a base portion 12, an upper portion 14, and a hollow spindle 16 that further includes a handle 18 attached to and/or forming its upper extremity. The base portion 12 serves as a receptacle, or container, for the cup of the toilet plunger (not shown) and includes a bottom portion 13*a* and an upper portion 13*b*. The bottom portion 13*a* may be flared radially outward as shown to provide additional stability for the device 10 as it stands on a surface, such as the floor of a bathroom.

The upper portion 14 includes a bottom 15*e* (discussed in more detail below), and vertical members 15*a*, 15*b* extending upwardly from and spaced circumferentially about the bottom 15*e*, separated by vertical openings 15*c*, 15*d*. Disposed within and secured to the bottom 15*e* of the upper portion 14 is a spindle 16 over which may be placed one or more rolls of toilet paper (not shown) in a coaxial and vertically stacked arrangement. The vertical openings 15*c*, 15*d* allow for visual inspection of available rolls of toilet paper, as well as easier retrieval of the stacked rolls. The upper extremities 15*aa*, 15*bb* of the vertical members 15*a*, 15*b* may also be flared radially outward to provide a larger opening for the stacking of rolls of toilet paper. As will be readily appreciated by one of ordinary skill in the art, fewer or more than two vertical members may be used. For example, a single vertical member may be used with a single vertical opening, or more than two vertical members may be used with a like number of vertical openings.

Accordingly, after the cup of a toilet plunger (not shown) has been placed inside the base portion 12, and the upper portion 14 with the hollow spindle 16 mechanically engaged therewith (discussed in more detail below) is placed atop the base portion 12, the cup of a toilet plunger is toilet-plunger enclosed by the base portion 12 and bottom 15*e* of the upper portion 14, and the handle of the toilet plunger is enclosed by the hollow spindle 16.

Figure 2:
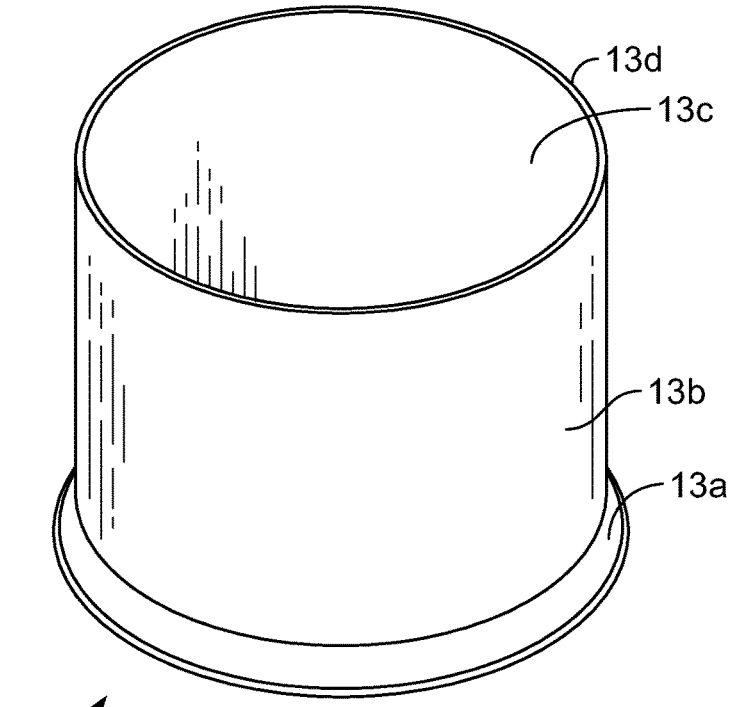
FIG. 2 depicts the base portion of the storage device of FIG. 1.

Referring to FIG. 2, the base portion 12 has a top opening 13*c* with a circumferential edge 13*d* that may be cylindrical in cross section. As will be readily appreciated by one of ordinary skill in the art, however, other cross sections may be used (e.g., various polygons).

Figure 3:
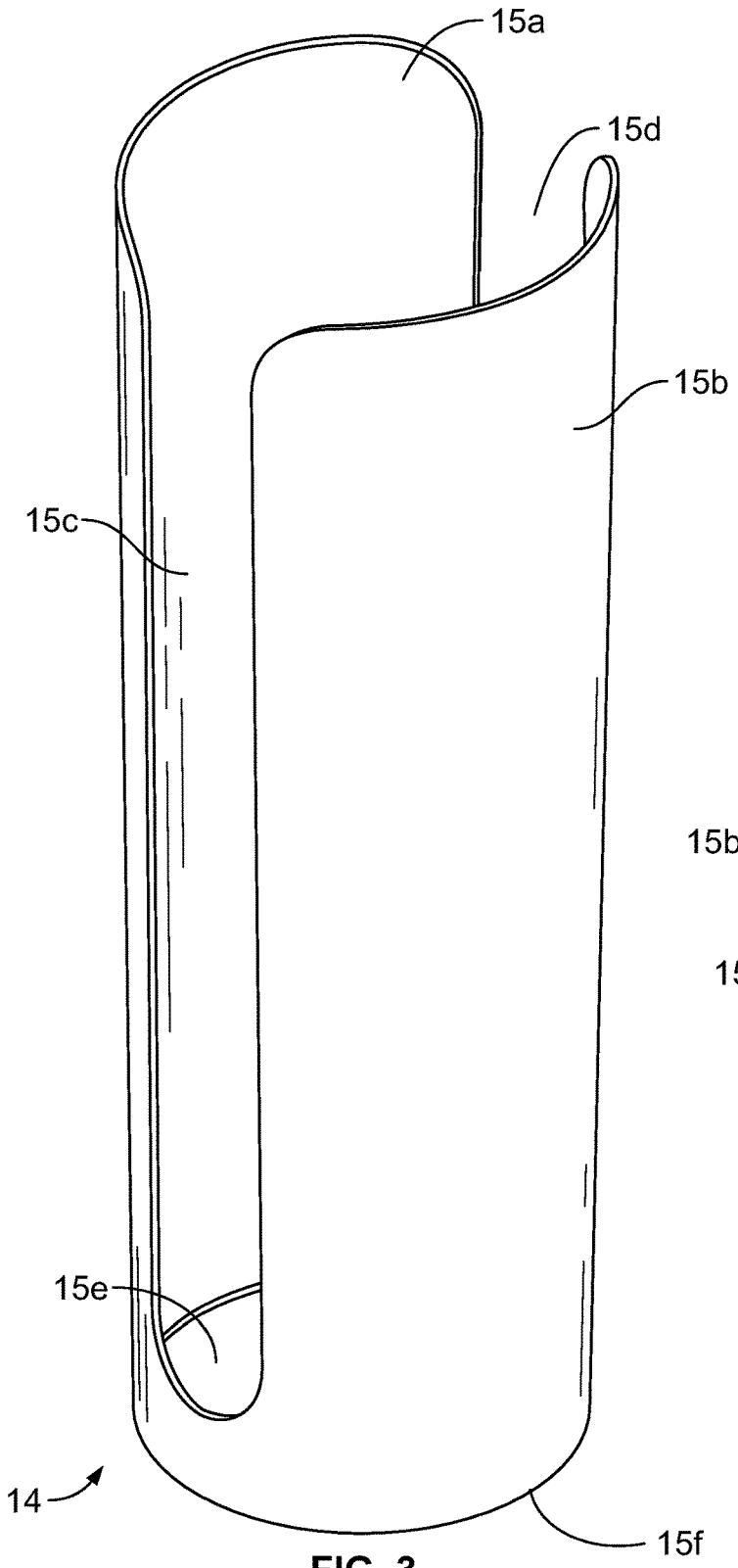
FIG. 3 depicts the upper portion of the storage device of FIG. 1.

Referring to FIG. 3, as noted above, the upper portion 14 of the storage device includes a bottom 15*e*. Accordingly, when the upper portion 14 is placed atop the base portion 12, the cup of the toilet plunger will be enclosed and out of sight.

Figure 3A:
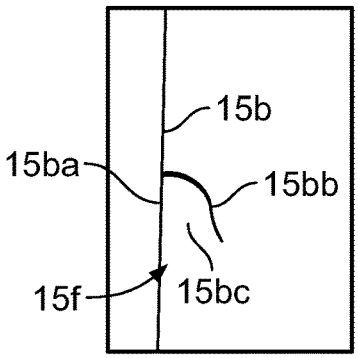
FIG. 3A depicts a cross-section of the bottom extremity of the upper portion of the storage device of FIG. 1.
Figure 6:
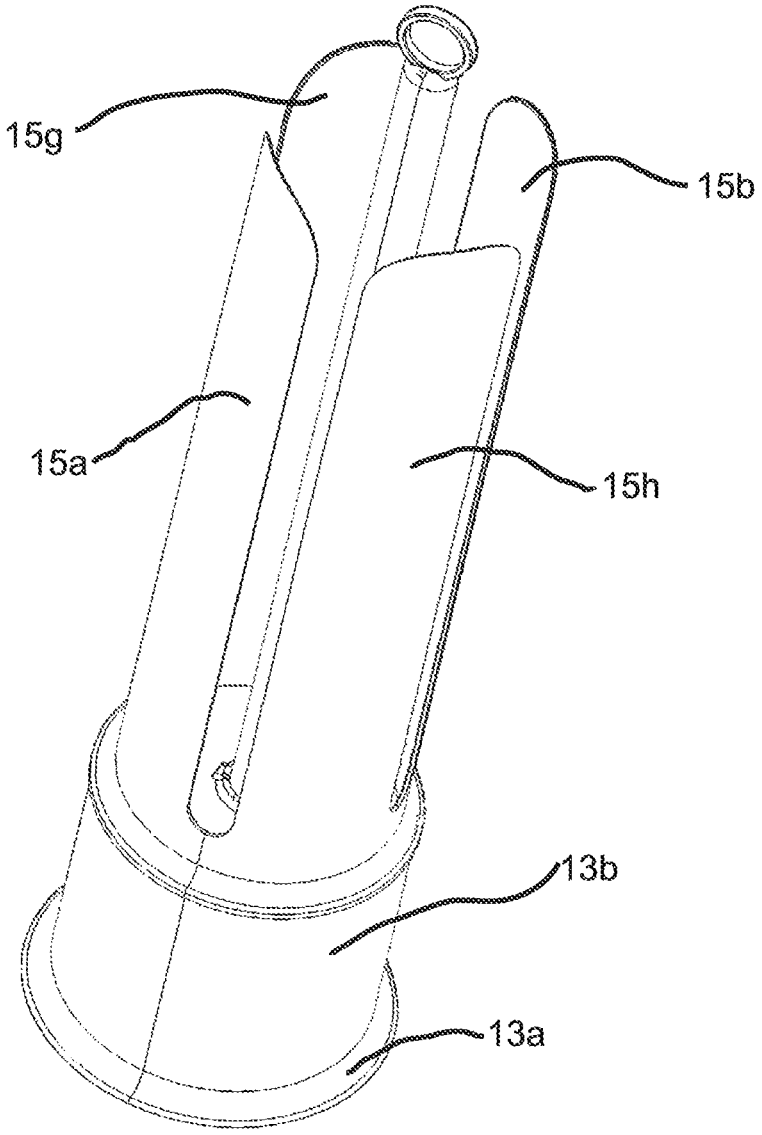
FIG. 6 depicts an alternative embodiment of the storage device of FIGS. 1 and 3A with an upper portion having four vertical members.

Referring to FIG. 3A, as shown in cross-section, the bottom ridge 15*f* of the upper portion 14 may be split to include a flange that is flared radially outward to create a larger shallow opening such that the upper portion 14 self-aligns and centers itself as it is placed atop the base portion 12 by the user. For example, at the bottom of the second vertical member 15*b*, a flange 15*bb* may flare radially outward from the bottom extremity 15*ba* to create a circumferential opening, or void, 15*bc* in which the circumferential edge 13*d* of the base portion 12 (FIG. 2) may be captured when the upper portion 14 is placed atop the base portion 12.

Figure 4:
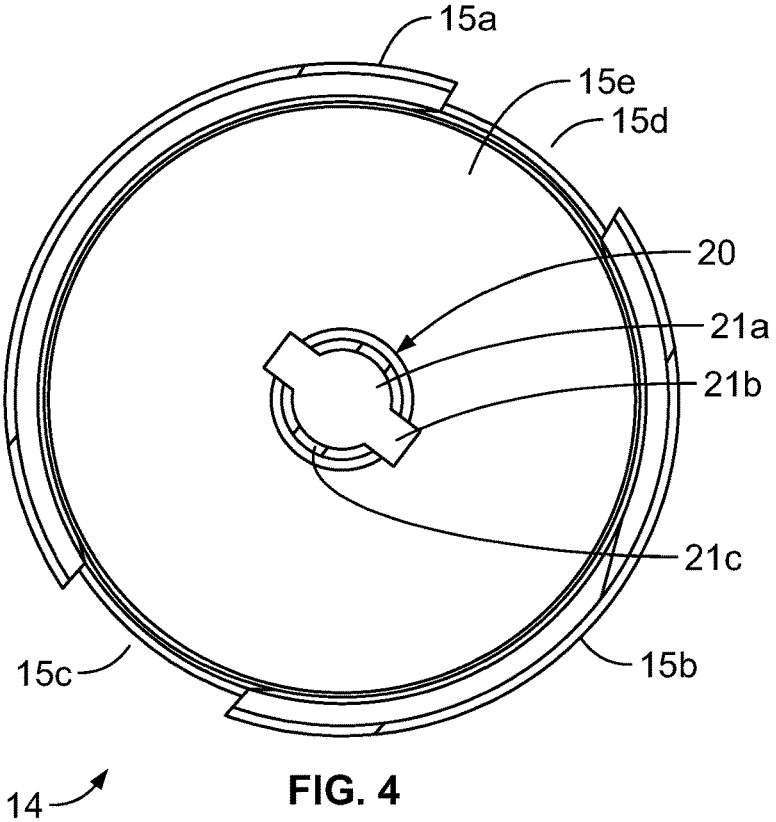
FIG. 4 depicts the inside of the bottom of the upper portion of FIG. 3.

Referring to FIG. 4, the inside of the bottom 15*e* of the upper portion 14 includes a mounting feature 20 for mechanically engaging the base of the spindle 16 (discussed in more detail below). Such mounting feature 20 may include an opening 21*a* (e.g., circular) with opposing slots 21*b* separating circumferential raised features 21*c* to form a receptacle portion of a bayonet mount, thereby allowing the base of the spindle 16 to be inserted and rotated into a locked position.

Figure 5:
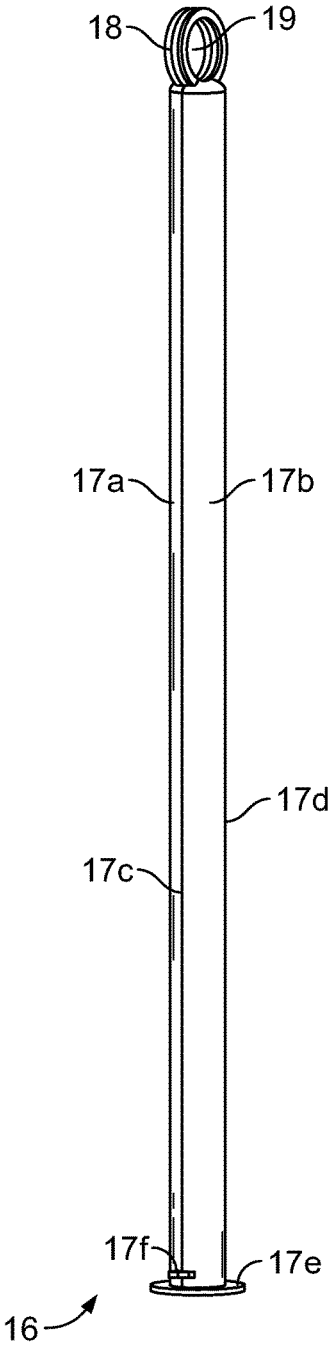
FIG. 5 depicts the spindle of the storage device of FIG. 1.

Referring to FIG. 5, the spindle 16 of the storage device 10 may be fabricated in two pieces 17*a*, 17*b* as mirror image halves and mechanically engaged along vertical seams 17*c* via integral interlocking flanges 17*c*. (The handle 18 may be integral with the spindle pieces 17 in which case it too will be formed in mirror image halves.) The base of the spindle 16 may include a circular flange 17*e* and raised opposing flanges 17*f* for engagement with the mounting feature 20 of the bottom 15*e* of the upper portion 14 as discussed above. The handle 18 may include an aperture 19 for facilitating grasping and lifting by the user of the upper portion 14 when seeking to access the enclosed toilet plunger. Such aperture 19 may be of virtually any desired shape (e.g., circular, oval, etc.).

As will be readily appreciate by one of ordinary skill in the art, embodiments of the storage devices as discussed herein may be implemented using various forms of materials and fabrication including, without limitation, plastics and/or metals, either of which may be molded or cast in accordance with well-known techniques.

Various other modifications and alterations in the structure and method of operation of this invention will be apparent to those skilled in the art without departing from the scope and the spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus for storing a toilet plunger and multiple rolls of toilet paper, comprising:

a base container with a top opening having a cross-sectional shape suitable for accommodating placement of a cup of said toilet plunger within said base container;

a cover unit including a base portion with a generally vertical bottom flange that is disposed circumferentially about and extends generally downward from said base portion and is adapted to enable mechanical engagement of said base portion with said top opening of said base container, a plurality of fixed members spaced circumferentially about and extending upwardly from a periphery of said base portion to define at least one opening extending from outside a side of the apparatus into a receiving space between the plurality of fixed members, and a hollow spindle disposed in the receiving space and mechanically engaged with and protruding generally upward from a top of said base portion, and adapted to accommodate insertion of a handle of said toilet plunger within said hollow spindle and placement of a plurality of rolls of toilet paper in the receiving space about said hollow spindle such that at least one of the plurality of rolls of toilet paper is accessible through the opening.

2. The apparatus of claim 1, wherein said hollow spindle includes a handle at an upper extremity of said hollow spindle.

3. The apparatus of claim 1, wherein said hollow spindle is mechanically coupled to a center of said base portion.

4. The apparatus of claim 1, wherein each of said plurality of members comprises a top portion flaring radially outwardly from said hollow spindle.

5. The apparatus of claim 1, wherein said base portion has said cross-sectional shape.

6. The apparatus of claim 1, wherein said base portion has a cylindrical shape.

7. An apparatus for storing a toilet plunger and multiple rolls of toilet paper comprising:

a base container with a top opening having a cross-sectional shape suitable for accommodating placement of a cup of said toilet plunger within said base container;

a cover unit including a base portion with a generally vertical bottom flange that is disposed circumferentially about and extends generally downward from said base portion and is adapted to enable mechanical engagement of said base portion with said top opening of said base container, and a first plurality of fixed members spaced circumferentially about and extending upwardly from a periphery of said base portion to define a first plurality of openings extending from outside a side of the apparatus into a receiving space between the first plurality of fixed members; and a hollow spindle disposed in the receiving space and adapted to be mechanically engaged with and protrude generally upwardly from a top of said base portion, wherein said hollow spindle accommodates insertion of a handle of said toilet plunger within said hollow spindle and placement of a first plurality of rolls of toilet paper in the receiving space about said hollow spindle such that at least one of the first plurality of rolls of toilet paper is accessible through the first plurality of openings.

8. The apparatus of claim 7, wherein said hollow spindle includes a handle at an extremity of said hollow spindle.

9. The apparatus of claim 7, wherein a center of said top of said base portion is adapted to mechanically engage said hollow spindle.

10. The apparatus of claim 7, wherein each of said plurality of members comprises a top portion flaring radially outwardly from said hollow spindle.

11. The apparatus of claim 7, wherein said base portion has said cross-sectional shape.

12. The apparatus of claim 7, wherein said base portion has a cylindrical shape.

* * * * *